United States Patent [19]

Brendlinger et al.

[11] 4,035,256

[45] July 12, 1977

[54] PROCESS FOR ELECTROLYTIC REMOVAL OF LUBRICANTS FROM STEEL STRIP

[75] Inventors: Edward C. Brendlinger, Pitcairn; Richard F. Higgs, Monroeville; Issa J. Kharouf, Penn Hills Township, Allegheny County, all of Pa.

[73] Assignee: United States Steel Corporation, Pittsburgh, Pa.

[21] Appl. No.: 678,341

[22] Filed: Apr. 19, 1976

[51] Int. Cl.[2] ..... C25F 1/00; C25F 1/06

[52] U.S. Cl. ..... 204/145 R; 204/141.5

[58] Field of Search ..... 204/145 R, 141.5, 207, 204/28, 206

[56] References Cited

U.S. PATENT DOCUMENTS

| | | | |
|---|---|---|---|
| 2,244,423 | 6/1941 | Hall | 204/145 R |
| 2,370,973 | 3/1945 | Lang | 204/28 |
| 2,395,437 | 2/1946 | Venable | 204/206 |
| 3,496,086 | 2/1970 | Stalson et al. | 204/28 |
| 3,650,935 | 3/1972 | Andersson | 204/145 R |

*Primary Examiner*—T. M. Tufariello

*Attorney, Agent, or Firm*—James O. Ray, Jr.

[57] ABSTRACT

A process for the electrolytic removal of lubricants from steel strip which significantly reduces the amount of power required while enhancing the degree of lubricant removal. The process comprises (i) electrolyzing the strip in an alkaline electrolyte by applying a current density within the range of 350 to 4,000 amps per square foot, and (ii) passing the strip lengthwise, at a speed of 450 to 3,000 feet per minute, between at least one pair of horizontally arranged electrodes in parallel spaced relation wherein the distance between a planar surface of the strip and its respective facing electrode is from one-fourth of an inch and no greater than 1½ inches. The amount of power required is significantly reduced by flowing the electrolyte co-current with the direction of strip travel at a flow velocity which is from 50 to 100 percent of the strip speed.

12 Claims, No Drawings

PROCESS FOR ELECTROLYTIC REMOVAL OF LUBRICANTS FROM STEEL STRIP

BACKGROUND OF THE INVENTION

This invention relates in general to cleaning lubricants from steel strip and, more particularly, to the electrolytic removal of lubricants from steel strip by the application of a high-current-density in an alkaline electrolyte.

U.S. Pat. No. 3,668,050, incorporated herein by reference, teaches an alkaline cleaning process using high current densities wherein particularly good cleaning is achieved at current densities of from 4,320 to 8,640 amps per square foot. The process shown therein is primarily limited to the cleaning of wire. With respect to sheet and strip having significantly greater surface area, the utilization of current densities in excess of 4,000 amps per square foot requires inordinately high power. Additionally, current densities of this order require very significant stirring of the electrolyte to overcome concentration polarization effects. The stirring methods shown by the above patent are generally ineffective for electrolyzing sheet or strip with large planar surfaces. However, stirring methods which are more applicable to strip are known in the art.

U.S. Pat. Nos. 3,471,375 and 3,535,222, incorporated herein by reference, show the use of high-current-density electrochemical apparatus and processes for pickling and anodizing aluminum strip.

U.S. Pat. No. 3,650,935, incorporated herein by reference, teaches a method and apparatus for high-current-density pickling of metal objects. This patent teaches the desirability of counter-current flow of electrolyte in combination with an electrode gap which decreases in the direction of movement of the metal being pickled for the purpose of achieving maximum electrochemical efficiency. The patent teaches that this tapered electrode spacing leads to the current densities required in conventional methods with a lower power input.

However, we discovered when trying to adapt the state-of-the-art technology to high speed cleaning of steel strip that unduly high power requirements were needed. In addition, cleaning was not satisfactory.

OBJECTS OF THE INVENTION

It is, therefore, the primary object of our invention to provide a process for the electrolytic removal of lubricants from steel strip wherein the strip is electrolyzed in an alkaline electrolyte by the application of a current density within the range of 350 to 40,000 amps per square foot.

Another object of our invention is to provide a process for high-current-density cleaning of lubricants from steel strip which significantly reduces the amount of power required while enhancing the degree of lubricant removal by flowing the electrolyte co-current to the direction of strip travel.

These and various other objects and advantages of our invention will become more apparent from the following detailed description.

BRIEF SUMMARY OF THE INVENTION

In the electrolytic removal of lubricants from steel strip wherein the strip is electrolyzed in an alkaline electrolyte by the application of a current density within the range of 350 to 4,000 amps per square foot it has been discovered that the amount of power required can be significantly reduced while enhancing the degree of lubricant removal. The improvement comprises, at a speed of 450 to 3,000 feet per minute, passing said strip lengthwise between at least one pair of horizontally arranged electrodes in parallel spaced relation, wherein the distance between a planar surface of the strip and its respective facing electrode is at least 1/4 of an inch and no greater than 1½ inches. Current within the above current density range is applied for a time sufficient to provide from 30 to 300 coulombs per square foot of surface area. In order to achieve the above advantages of reduced power requirements and superior cleaning, it is necessary to flow the electrolyte co-current with the direction of strip travel and at a flow velocity which is from 50 to 100 percent of the speed of the strip; the flow velocity being at least sufficient to support the applied current density.

PREFERRED EMBODIMENTS

Table I shows the effect of electrolyte flow direction in high-current-density cleaning on power requirements and strip cleanliness at different strip to electrode distances.

TABLE I

EFFECT OF SOLUTION FLOW DIRECTION IN HCD CLEANING ON VOLTAGE REQUIREMENTS AND STRIP CLEANLINESS AT DIFFERENT STRIP TO ELECTRODE DISTANCES

| Co-Current Flow | | | | Counter-Current Flow | | | |
|---|---|---|---|---|---|---|---|
| Sample Code | C.D. Asf | Volts | Clean. Reading | Sample Code | C.D. Asf | Volts | Clean. Reading |
| | | ⅜" Strip to Electrode | | | | | |
| 1268-1 | 926 | 11.0 | 139.5 | 1267-9 | 926 | 32.2 | 142.0 |
| 1268-2 | 463 | 6.5 | 137.5 | 1267-10 | 463 | 17.7 | 145.5 |
| 1268-3 | 370 | 5.5 | 138.0 | 1267-11 | 370 | 13.2 | 138.0 |
| 1168-4 | 278 | 4.7 | 163.0 | 1267-12 | 278 | 10.2 | 168.5 |
| | | ½" Strip to Electrode | | | | | |
| 1269-12 | 926 | 12.0 | 152.0 | 1266-1 | 926 | 33.0 | 158.5 |
| 1269-11 | 463 | 7.0 | 159.0 | 1266-2 | 463 | 18.0 | 262.5 |
| 1269-10 | 370 | 5.7 | 171.5 | 1266-3 | 370 | 15.5 | 285.5 |
| 1269-9 | 278 | 4.7 | 181.0 | 1266-4 | 278 | 11.5 | 303.5 |
| | | ¾" Strip to Electrode | | | | | |
| 1268-9 | 926 | 16.5 | 142.5 | 1267-1 | 926 | 33.0 | 155.0 |
| 1268-10 | 463 | 9.7 | 147.0 | 1267-2 | 463 | 18.0 | 160.0 |
| 1268-11 | 370 | 8.5 | 141.0 | 1267-3 | 370 | 14.2 | 171.5 |
| 1268-12 | 278 | 6.6 | 174.0 | 1267-4 | 278 | 10.7 | 195.0 |
| | | 1" Strip to Electrode | | | | | |
| 1268-13 | 926 | 18.7 | 137.0 | 1267-5 | 926 | 34.0 | 142.0 |
| 1268-14 | 463 | 10.7 | 142.0 | 1267-6 | 463 | 17.7 | 145.0 |

TABLE I-continued

EFFECT OF SOLUTION FLOW DIRECTION IN HCD CLEANING ON VOLTAGE REQUIREMENTS AND STRIP CLEANLINESS AT DIFFERENT STRIP TO ELECTRODE DISTANCES

| Co-Current Flow | | | | Counter-Current Flow | | | |
|---|---|---|---|---|---|---|---|
| Sample Code | C.D. Asf | Volts | Clean. Reading | Sample Code | C.D. Asf | Volts | Clean. Reading |
| 1168-15 | 370 | 9.0 | 145.5 | 1267-7 | 370 | 14.7 | 153.5 |
| 1268-16 | 278 | 7.1 | 159.5 | 1267-8 | 278 | 10.7 | 172.5 |

Samples 1267 and 1268 had a cleanometer reading of 546 for uncleaned strip and a base count (clean strip) of 123 while samples 1266 and 1269 had a cleanometer reading of 521 for the uncleaned strip and a base count of 138 for an essentially clean strip. The samples were all exposed to the electrodes for the same amount of time.

As can be seen from Table I at all levels of current density and at all strip to electrode distances within our ranges the power requirements are lower and the degree of lubricant removal is enhanced.

In order to make our process more economical we prefer to include the additional steps of collecting the electrolyte, after travelling through the cell, in a holding source wherein the electrolyte is heated to between 160° F and 200° F. We also can add sufficient cleaning compound and water to the electrolyte in the holding source to maintain an alkalinity concentration between about 1.0 to 10.0 percent by weight of the electrolyte. Also, the electrolyte can be held for a time at least sufficient to allow a portion of the sludge removed from the strip to settle.

Table II shows the effect of oil contamination on the maximum obtainable current densities at different levels of oil concentration in the electrolyte.

TABLE II

OIL CONTAMINATION

| Ex. No. | % Oil (w) | Volts | Max. C. D. Attainable T | Max. C. D. Attainable B |
|---|---|---|---|---|
| 12 | 0.2 | 42.7 | 3704 | 3518 |
| 13 | 0.5 | 46.0 | 2778 | 2555 |
| 14 | 0.9 | 47.5 | 1667 | 2407 |
| 15 | 1.1 | 48.5 | 963 | 2200 |

TABLE II-continued

OIL CONTAMINATION

| Ex. No. | % Oil (w) | Volts | Max. C. D. Attainable T | Max. C. D. Attainable B |
|---|---|---|---|---|
| 16 | 1.3 | 48.5 | 741 | 1852 |

TABLE I

EFFECT OF SOLUTION FLOW DIRECTION IN HCD CLEANING ON VOLTAGE REQUIREMENTS AND STRIP CLEANLINESS AT DIFFERENT STRIP TO ELECTRODE DISTANCES

| Co-Current Flow | | | | Counter-Current Flow | | | |
|---|---|---|---|---|---|---|---|
| Sample Code | C.D. Asf | Volts | Clean. Reading | Sample Code | C.D. Asf | Volts | Clean. Reading |
| | | | ⅜" Strip to Electrode | | | | |
| 1268-1 | 926 | 11.0 | 139.5 | 1267-9 | 926 | 32.2 | 142.0 |
| 1268-2 | 463 | 6.5 | 137.5 | 1267-10 | 463 | 17.7 | 145.5 |
| 1268-3 | 370 | 5.5 | 138.0 | 1267-11 | 370 | 13.2 | 138.0 |
| 1168-4 | 278 | 4.7 | 163.0 | 1267-12 | 278 | 10.2 | 168.5 |
| | | | ½" Strip to Electrode | | | | |
| 1269-12 | 926 | 12.0 | 152.0 | 1266-1 | 926 | 33.0 | 158.5 |
| 1269-11 | 463 | 7.0 | 159.0 | 1266-2 | 463 | 18.0 | 262.5 |
| 1269-10 | 370 | 5.7 | 171.5 | 1266-3 | 370 | 15.5 | 285.5 |
| 1269-9 | 278 | 4.7 | 181.0 | 1266-4 | 278 | 11.5 | 303.5 |
| | | | ¾" Strip to Electrode | | | | |
| 1268-9 | 926 | 16.5 | 142.5 | 1267-1 | 926 | 33.0 | 155.0 |
| 1268-10 | 463 | 9.7 | 147.0 | 1267-2 | 463 | 18.0 | 160.0 |
| 1268-11 | 370 | 8.5 | 141.0 | 1267-3 | 370 | 14.2 | 171.5 |
| 1268-12 | 278 | 6.6 | 174.0 | 1267-4 | 278 | 10.7 | 195.0 |
| | | | 1" Strip to Electrode | | | | |
| 1268-13 | 926 | 18.7 | 137.0 | 1267-5 | 926 | 34.0 | 142.0 |
| 1268-14 | 463 | 10.7 | 142.0 | 1267-6 | 463 | 17.7 | 145.0 |
| 1168-15 | 370 | 9.0 | 145.5 | 1267-7 | 370 | 14.7 | 153.5 |
| 1268-16 | 278 | 7.1 | 159.5 | 1267-8 | 278 | 10.7 | 172.5 |

It is seen that increasing oil concentration in the cleaning solution results in (1) loss of conductivity of cleaning solution, (2) more foaming characteristics of cleaning solution, and (3) decrease in the maximum attainable current density, even at slightly increased voltages.

Therefore, it is desirable that the electrolyte be changed when the oil concentration reaches about 1.0 percent by weight of the electrolyte and preferably when it reaches between about 0.1 to about 0.5 percent by weight of the electrolyte.

With co-current flow of the electrolyte larger amounts of oil concentration in the electrolyte were found tolerable because the oil was continuously being swept out of the cell.

In order to achieve a desirable level of cleaning, with practical power requirements it is also necessary that the strip be electrolyzed in an alkaline electrolyte by the application of a current density within the range of 350 to 4,000 amps per square foot.

The steel strip, at a speed of 450 to 3,000 feet per minute is passed lengthwise between at least one pair of horizontally arranged electrodes in parallel spaced relation such that the distance between a planar surface of the strip and its respective facing electrode is at least one-fourth of an inch and no greater than 1½ inches. Preferably a distance of from one-fourth of an inch to no greater than three-fourth of an inch is maintained.

Current is applied in the range of 350 to 4,000 amps per square foot of surface area. Preferably the current is applied for a time sufficient to provide from 100 to 200 coulombs per square foot of a surface area at a current density of at least 865 amps per square foot of surface area.

Flowing the electrolyte co-current with the direction of strip travel, at a flow velocity which is from about 50 to 100 percent of the speed of the strip. The flow velocity being at least sufficient to support the applied current density. Preferably the flow velocity is maintained between 70 to 80 percent of the speed of the strip.

In our process the electrolyte is maintained at a temperature of from 160° to 200° F and has an alkalinity concentration of from 1.0 to 15.0 percent by weight of the electrolyte. We prefer to maintain the temperature between about 175° to 190° F and the alkalinity concentration between about 3.0 to 6.0 percent by weight of the electrolyte. It is preferable that one of the components of the electrolyte be selected from the group consisting of sodium hydroxide, potassium hydroxide and mixtures thereof. In addition, it is desirable to maintain the electrolyte substantially free of trapped gases.

While we have described our preferred and alternative embodiments it will be understood by those skilled in the art that other adaptations and modifications may be made without departing from the scope of the appended claims.

We claim:

1. In the electrolytic removal of lubricants from steel strip wherein said strip is electrolyzed in an alkaline electrolyte by the application of a current density within the range of 350 to 4,000 amps per square foot, the improvement for significantly reducing the amount of power required while enhancing the degree of lubricant removal, which comprises;

at a speed of 450 to 3,000 feet per minute, passing said strip lengthwise between at least one pair of horizontally arranged electrodes in parallel spaced relation, wherein the distance between a planar surface of said strip and its respective facing electrode is at least one-fourth of an inch and no greater than 1½ inches, applying said current for a time sufficient to provide from 30 to 300 coulombs per square foot of surface area, and flowing said electrolyte between said electrodes co-current with the direction of strip travel, at a flow velocity which is from about 50 to 100 percent of said speed of said strip, said flow velocity being at least sufficient to support said applied current density.

2. A process according to claim 1 wherein said electrolyte is maintained at a temperature of from 160° to 200° F and has an alkalinity concentration of from 1.0 to 15.0 percent by weight of said electrolyte.

3. A process according to claim 2 wherein said temperature is from 175° to 190° F and said alkalinity concentration is between 3.0 to 6.0 percent by weight of said electrolyte.

4. A process according to claim 1 wherein said flow velocity is between 70 to 80 percent of said speed of said strip.

5. A process according to claim 1 wherein said current applied is sufficient to provide from 100 to 200 coulombs per square foot of surface area and provide a current density of at least 865 amps per square foot of surface area.

6. A process according to claim 1 wherein said distance between said planar surface of said strip and its respective facing electrode is from one-fourth inch to three-fourth of an inch.

7. A process according to claim 1 including the additional steps of collecting said electrolyte in a holding source wherein said electrolyte is heated to between about 160° to about 200° F, and adding cleaning compound and water in an amount sufficient to maintain an alkalinity concentration of from about 1 to about 10 percent by weight of said solution.

8. A process according to claim 7 including the additional step of holding said electrolyte in said holding source for a time at least sufficient to allow a portion of sludge removed from said strip to settle.

9. A process according to claim 8 including the additional step of changing said solution when the oil concentration reaches about 1.0 percent by weight of said solution.

10. A process according to claim 9 wherein said oil concentration is between about 0.1 to about 0.5 percent by weight of said solution.

11. A process according to claim 1 wherein one of the components of said electrolyte is selected from the group consisting of sodium hydroxide, potassium hydroxide and mixtures thereof.

12. A process according to claim 1 wherein said electrolyte is substantially free of trapped gases.

* * * * *